United States Patent [19]

Rellis, Jr. et al.

[11] Patent Number: 4,747,584

[45] Date of Patent: May 31, 1988

[54] APPARATUS FOR INJECTING ALLOYING INGREDIENT INTO MOLTEN METAL STREAM

[75] Inventors: Daniel Rellis, Jr., Lansing, Ill.; Roger J. Glennon, Munster, Ind.

[73] Assignee: Inland Steel Company, Chicago, Ill.

[21] Appl. No.: 51,943

[22] Filed: May 19, 1987

[51] Int. Cl.[4] ..... C21C 7/00

[52] U.S. Cl. ..... 266/287; 266/216; 266/207; 266/270; 420/86; 420/129

[58] Field of Search ..... 266/207, 216, 270, 287; 420/86, 129; 222/591, 606; 164/335, 337, 437

[56] References Cited

U.S. PATENT DOCUMENTS

| | | | |
|---|---|---|---|
| 3,511,490 | 5/1970 | Brown, Jr. et al. | 266/216 |
| 3,728,109 | 4/1973 | Okubo et al. | 420/86 |
| 3,814,405 | 6/1974 | Ormaechea | 266/216 |
| 4,010,938 | 3/1977 | Crudup | 266/216 |
| 4,303,118 | 12/1981 | Coward | 164/437 |
| 4,352,605 | 10/1982 | Godding et al. | 75/46 |
| 4,371,395 | 2/1983 | Ogletree | 420/86 |
| 4,389,249 | 6/1983 | Holowaty et al. | 420/86 |
| 4,391,319 | 7/1983 | Heaslip et al. | 266/217 |
| 4,519,587 | 5/1985 | Peckels et al. | 266/216 |
| 4,602,949 | 7/1986 | Rellis, Jr. et al. | 420/86 |
| 4,630,801 | 12/1986 | Rellis, Jr. et al. | 266/216 |

FOREIGN PATENT DOCUMENTS

| | | | |
|---|---|---|---|
| 0117016 | 6/1943 | Australia | 420/86 |
| 0117017 | 6/1943 | Australia | 420/86 |
| 0118161 | 3/1944 | Australia | 420/86 |
| 1110712 | 5/1986 | Japan | 266/216 |

*Primary Examiner*—L. Dewayne Rutledge
*Assistant Examiner*—David Schumaker
*Attorney, Agent, or Firm*—Marshall, O'Toole, Gerstein, Murray & Bicknell

[57] ABSTRACT

A vertical conduit extends from the bottom of a ladle containing molten metal and terminates at a lower end above a tundish for receiving the molten metal. A vertical shroud encloses the vertical conduit from a location above the conduits's lower end, and the shroud extends into the tundish. A nozzle extends into the interior of the shroud for feeding alloying ingredient, as shot, into a stream of the molten metal, within the shroud. Structure is provided for circulating a cooling fluid through the nozzle. The nozzle is connected to flexible feed lines for transporting shot and cooling fluid to the nozzle. Additional structure is provided for preventing the flexible feed lines from bending, twisting, kinking or the like when the nozzle, shroud and vertical conduit are rotated about a vertical axis spaced from the center line of the vertical conduit.

17 Claims, 3 Drawing Sheets

112
6
109
103
110
111
102
113
6
97
95

54
103
101
95
100
97
102

47
56
100
75
99
95
103
96
97
98
102
7
7
118
53

97
103
95
100
101
102

95
47
101
100
97
108
107
96
119
106
118
53
105

59
61
60
57
62
63
58
70
67
71
65
68
79
61
83
77
60
80
62
66
82
84
78
85

APPARATUS FOR INJECTING ALLOYING INGREDIENT INTO MOLTEN METAL STREAM

BACKGROUND OF THE INVENTION

The present invention relates generally to apparatus for injecting alloying ingredients into a stream of molten metal and more particularly to apparatus for injecting an alloying ingredient having a relatively low melting point into a stream of molten steel.

Among the alloying ingredients added to steel to improve its machinability are low melting point ingredients such as lead or bismuth. In the continuous casting of molten steel, a stream of molten steel flows downwardly from a ladle into a tundish. Lead in the form of shot may be added to this stream. It is desirable to enclose the entirety of the stream within a shroud and add the lead to the stream inside that shroud.

Such an arrangement is disclosed in Rellis, et al., U.S. Pat. No. 4,602,949 issued July 29, 1986. In that arrangement there is an inner conduit and a concentric outer shroud. The inner conduit or tube extends downwardly from the bottom of the ladle and a stream of molten steel flows through this inner conduit. The outer shroud is concentric with and radially spaced from the inner conduit and extends from above the bottom of the inner conduit to below the top surface of the bath of molten steel in the tundish. The bottom of the inner conduit terminates substantially above the bottom of the outer shroud, and the lead shot is injected into the stream of molten steel, below the bottom of the inner conduit, through a feed nozzle which extends angularly downwardly through the wall of the outer shroud.

The feed nozzle is composed of a metal such as stainless steel. The upstream end of the feed nozzle is connected to a line or hose through which the lead shot is conducted by a transport gas. By injecting lead shot into the stream of molten steel within the confines of the outer shroud, the escape of lead fumes into the surrounding atmosphere is minimized. Additional information on this apparatus and the method in which it is employed is disclosed in said Rellis, et al. patent, and the disclosure thereof is incorporated herein by reference.

The shroud is composed of refractory material, and the temperature within the shroud interior is relatively high. This causes the nozzle to heat up, and there is a decreasing temperature gradient extending upstream from the nozzle outlet at the downstream end of the nozzle. This can cause premature melting of the lead shot, in the nozzle, and can also cause lead shot, at locations upstream of the nozzle outlet to become sticky or tacky. As a consequence, there can be a build-up of lead within the nozzle, at a location upstream of the nozzle outlet, eventually causing a lead flow blockage within the nozzle.

There is another problem which can arise when employing a concentric conduit and shroud arrangement of the type described above. More particularly, the inner conduit has an upper open end communicating with an opening in a rotary gate mounted on the bottom of the ladle. Periodically, this gate is rotated between open and closed positions, e.g. at the beginning and the end of a cast, and at times in between. When the rotary gate is in its open position, molten metal will flow out of the ladle, through an opening in the gate and through the inner conduit of the double shroud. When the rotary gate is in a closed position, no molten metal will flow out of the ladle.

When the top of the inner conduit is connected to the rotary gate, and the rotary gate is rotated, the inner conduit and everything connected thereto, including the outer shroud and the nozzle extending through the outer shroud, will rotate about the axis of the rotary gate. Any flexible lines or hoses connected to the nozzle (e.g. the lead shot feed line) will be moved as the nozzle rotates about the axis of the rotary gate. As a result of such movement, a flexible line connected to the nozzle can become bent, twisted or kinked, and this would interfere with flow through that line. In addition, there are opposing pulls or forces acting on the nozzle, due to the urging of the shroud, on the one hand, and the drag of the flexible lines attached to the nozzle, on the other hand. These opposing forces can create stresses on the shroud at the location where the nozzle extends through the shroud. This can cause cracking or breaking or be otherwise injurious to the shroud at that location.

SUMMARY OF THE INVENTION

An apparatus in accordance with the present invention eliminates the drawbacks and disadvantages which can arise when employing equipment of the general type described above.

A special nozzle construction is employed to prevent premature melting of the lead shot within the nozzle and to prevent lead build-up or blockage within the nozzle. More particularly, the nozzle is composed of inner and outer tubular members. The mixture of transport gas and lead shot is conducted through the inner tubular member. A cooling fluid is circulated through the outer tubular member to cool the inner member. Baffles and passageway are provided between the two tubular members to define a path along which the cooling fluid flows from an inlet location adjacent the upstream end of the nozzle downwardly towards the downstream end of the nozzle and then back upwardly toward the upstream end of the nozzle where the cooling fluid is withdrawn from the nozzle.

Cooling fluid is both introduced and withdrawn from the nozzle at locations outside the shroud. It is undesirable to exhaust the cooling fluid inside the shroud, because that has an undesirable cooling effect on the stream of molten steel descending within the shroud. It is undesirable and inconvenient to introduce the cooling fluid into the nozzle at a location adjacent the downstream end of the nozzle because the downstream end is located within the shroud. As such, it is relatively inaccessible to transporting lines for the cooling fluid, and introducing the cooling fluid at the downstream end of the nozzle could unduly preheat the cooling fluid.

To combat problems which can arise when the nozzle rotates with the shroud about the axis of the rotary ladle gate, the nozzle is mounted on the concentric conduit and shroud in such a manner that the nozzle will simultaneously rotate about its own center line, in a sense opposite the sense in which the shroud and nozzle rotate about the axis of the rotary gate, during movement about the axis of the rotary gate.

The above-described mounting arrangement for the nozzle normally allows that part of a connected flexible feed line immediately adjacent the nozzle to extend from the nozzle in substantially parallel directions at all times no matter the location to which the nozzle has been moved during rotation about the vertical axis of the rotary ladle gate. Opposing forces on the nozzle, creating stresses on the shroud, are minimized.

Other features and advantages are inherent in the apparatus claimed and disclosed or will become apparent to those skilled in the art from the following detailed description in connection with the accompanying diagrammatic drawing.

DETAILED DESCRIPTION

Figure 1:
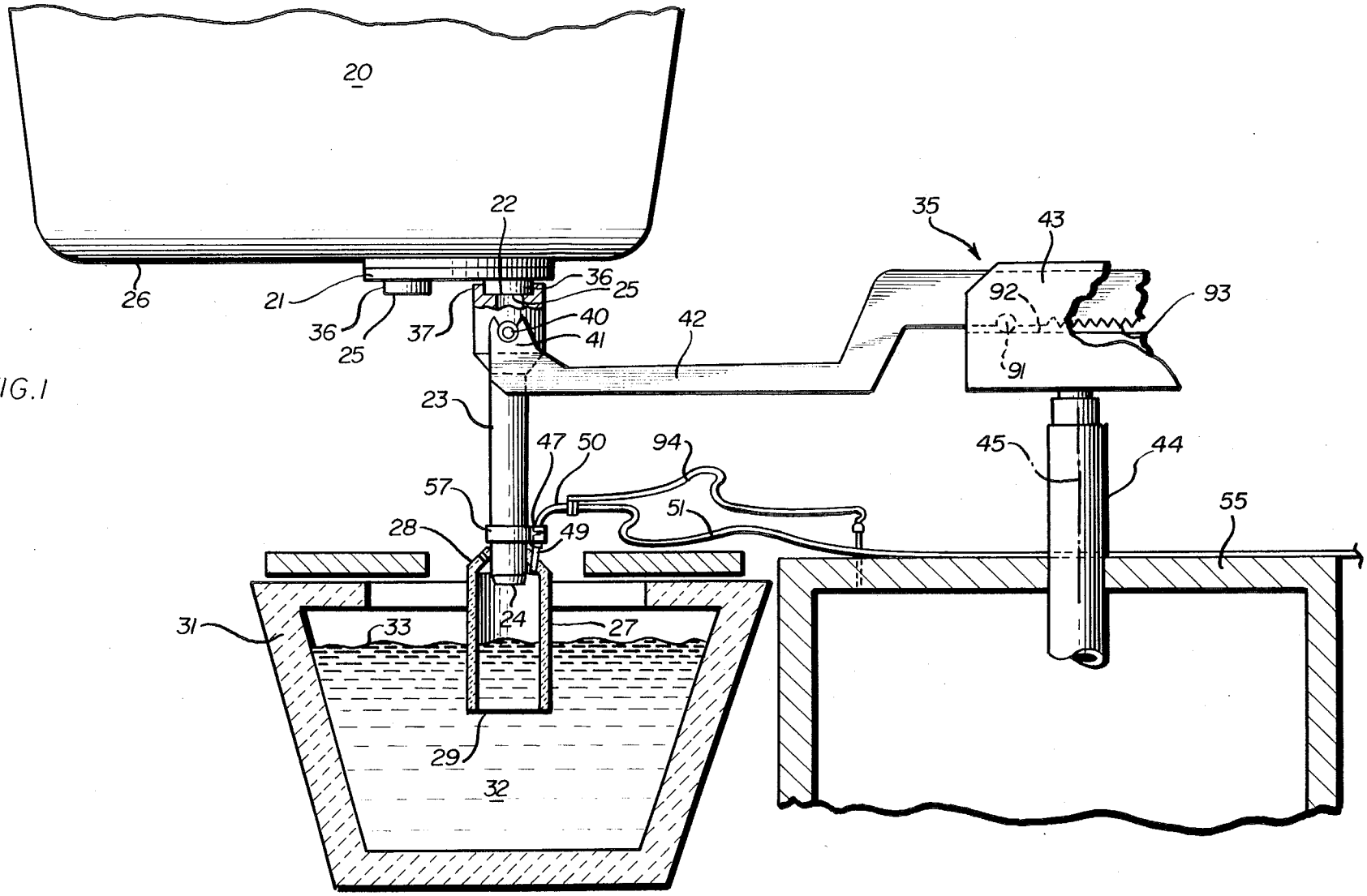
FIG. 1 is a side elevation view, partially in section, illustrating continuous casting equipment employing apparatus in accordance with the present invention.
Figure 2:
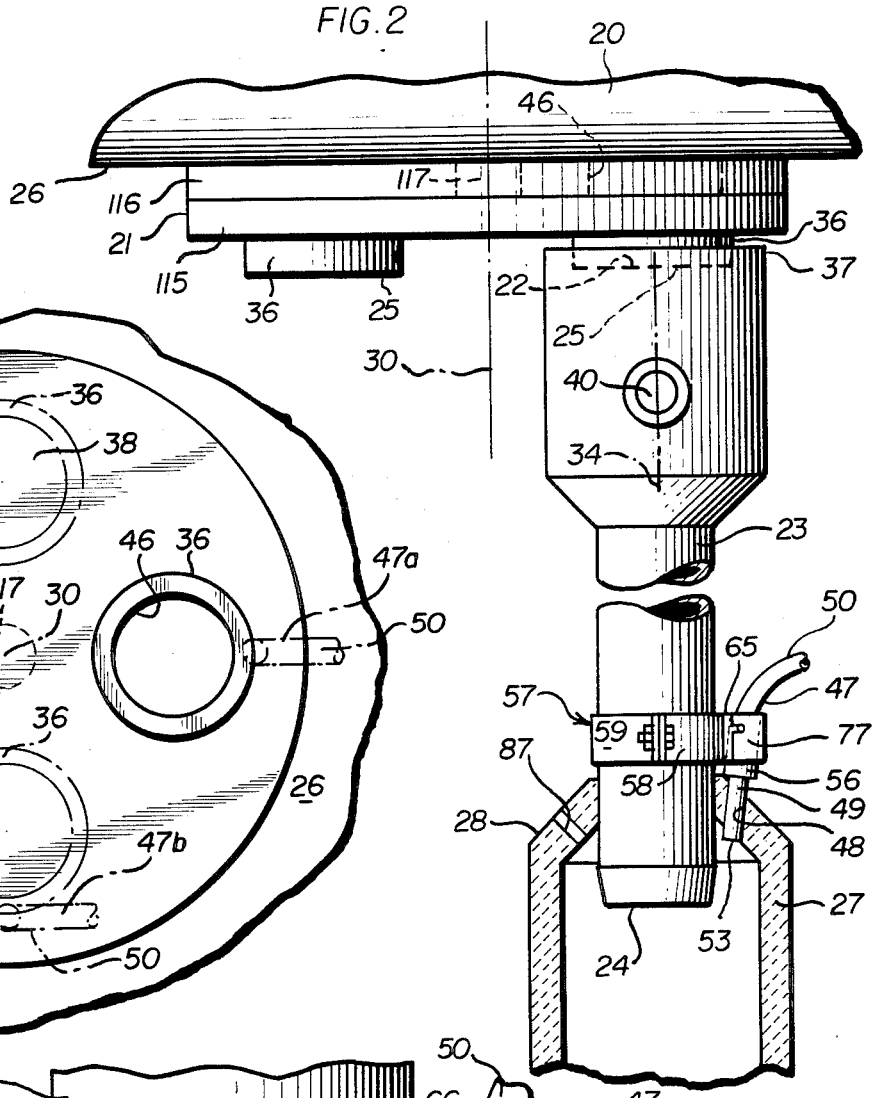
FIG. 2 is an enlarged, fragmentary, side elevational view, partially in section, illustrating an embodiment of apparatus in accordance with the present invention.
Figure 3:
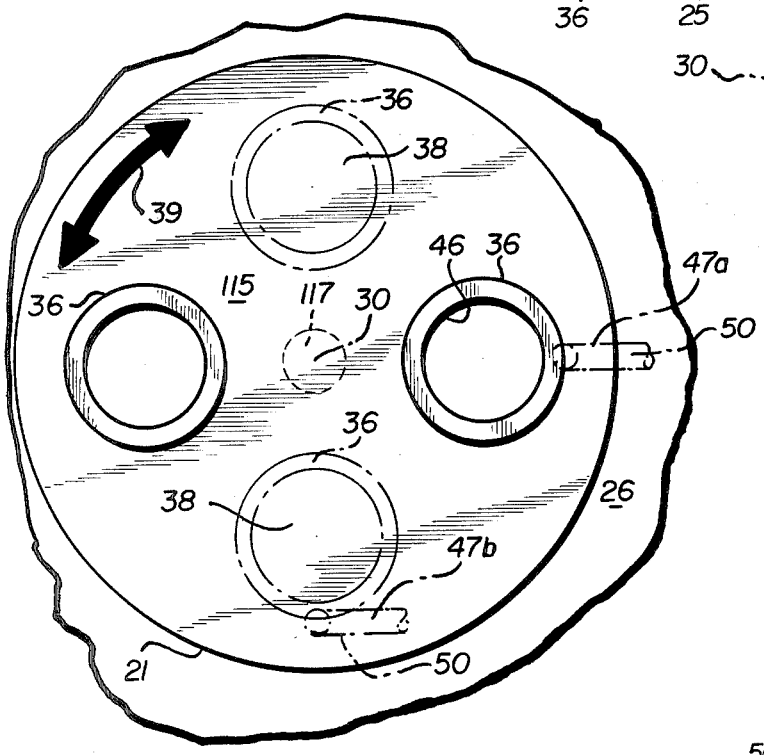
FIG. 3 is a bottom view of a rotary ladle gate with which the apparatus of FIG. 2 is used.

Referring initially to FIGS. 1-3, there is shown a ladle 20 having a bottom 26 on which is mounted a rotary gate 21 comprising a pair of tubular projections 36, 36 each having a bottom opening 25 against one of which is positioned the open upper end 22 of a vertically disposed conduit 23 having a vertically disposed center line and a lower open end 24. Surrounding or enclosing the lower portion of conduit 23 is a vertically disposed, tubular shroud 27 having an upper end portion 28 through which conduit 23 extends. Conduit 23 has a lower open end 24 located substantially above the lower open end 29 of shroud 27 which extends downwardly below the top surface 33 of a bath 32 of molten steel contained within a tundish 31.

Shroud 27 and conduit 23 are both composed of refractory material, and shroud 27 is mounted on or fixed to conduit 23 in a conventional manner so as to enable movement of the shroud and the conduit together.

Referring to FIG. 2, rotary gate 21 has a vertical axis of rotation (dash-dot line 30) horizontally spaced from vertical center line 34 of conduit 23. Rotary gate 21 comprises a rotatable lower plate 115 containing projections 36, 36. Plate 115 is rotatably mounted at 117 on a stationary upper plate 116 attached to ladle bottom 26 and containing an opening 46 communicating with an outlet opening (not shown) in ladle bottom 26. When a tubular projection 36 on lower plate 115 is located directly below opening 46 on upper plate 116, molten metal from ladle 20 can flow through gate 21.

Referring again to FIG. 1, projection 36 is received within and engaged by a peripheral flange 37 at the upper end of conduit 23. As a result of this engagement, when rotary gate 21 rotates about its axis 30, conduit 23 and shroud 27 also rotate about axis 30.

Conduit flange 37 is held in engagement with projection 36 by a manipulator 35 now to be described. Extending outwardly in opposite directions from the upper portion of tube 23 are a pair of pins 40 (only one of which is shown) each pivotally mounted on one of a pair of ears 41 (only one of which is shown) extending upwardly from a substantially horizontal manipulator arm 42 extending from a manipulator base 43 mounted on a vertically disposed manipulator shaft 44 having an axis of rotation 45. Shaft 44 is vertically movable relative to a manipulator platform 55. Arm 42 is movable toward and away from ladle 20, employing structure to be subsequently described, and arm 42 is also pivotable with base 43 about axis 45 of shaft 44. This mobility enables arm 42 to accommodate movement of conduit 23 about axis 30 of rotary gate 21 while maintaining intimate engagement between conduit flange 37 and rotary gate projection 36.

Figure 4:
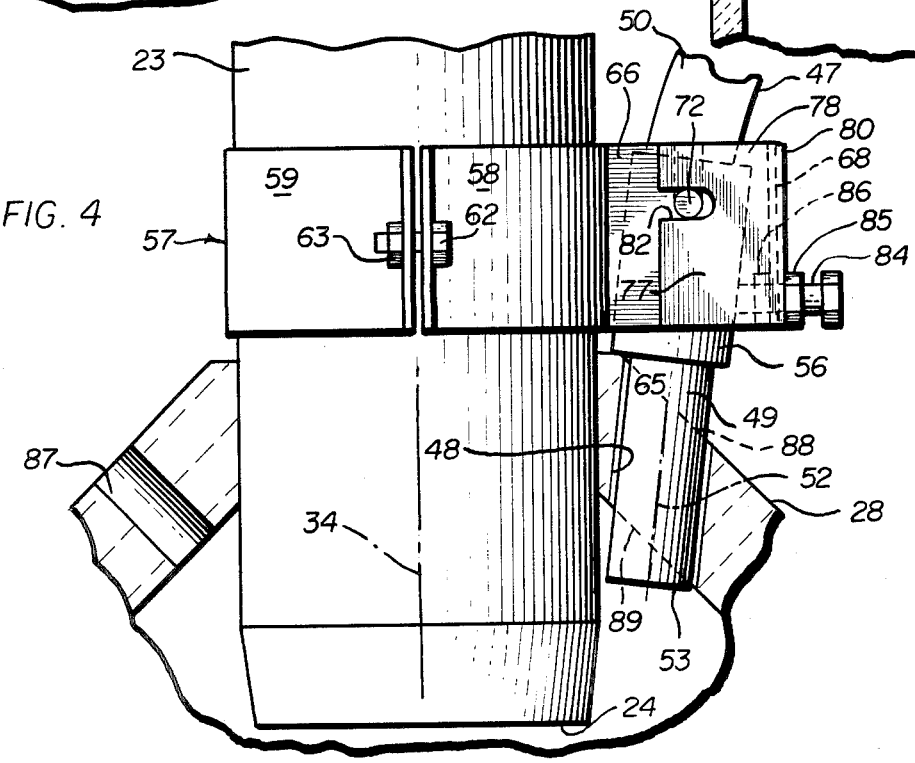
FIG. 4 is a further enlarged, fragmentary, side elevational view illustrating a portion of that which is illustrated in FIG. 2.

Referring to FIGS. 2 and 4, the shroud's upper end portion 28 has an opening 48 through which extends one portion 49 of a nozzle 47 also having another portion 50 communicating with portion 49. Nozzle portion 49 is straight while nozzle portion 50 is curved. Nozzle portion 50 communicates with a flexible transport line 51 (FIG. 1) through which a mixture of transport gas and alloying ingredient (e.g. lead shot) are conducted to the nozzle from a supply source (not shown).

Nozzle 47 has a downstream open end 53 communicating with the interior of shroud 27 and an upstream open end 54 (FIG. 5) for connection to flexible feed line 51. Straight nozzle portion 49 terminates at downstream nozzle end 53 and has a center line 52 extending in a direction having a vertical component.

Referring to FIG. 3, lower plate 115 on gate 21 is rotated about gate axis 30 in one or the other of two senses indicated by arrow 39 in FIG. 3. When plate 115 is in an operative position to allow flow through gate 21, tubular projections 36, 36 are in the positions illustrated in solid lines in FIG. 3. In this position, one projection 36 (to the right in FIG. 3) communicates with an outlet opening in the bottom of ladle 20 through opening 46 in stationary upper plate 116. In order to shut off the flow of molten steel from ladle 20, lower plate 115 is rotated 90° until projection 36 is at either position illustrated in dash-dot lines in FIG. 3. This is an inoperative position for the gate, and in this position, the flow of molten steel from ladle 20 through projection 36 is blocked by a solid portion of upper gate plate 116, indicated at 38 in FIG. 3. At the same time, a solid portion on lower gate 115 blocks the flow of molten steel through opening 46 on upper plate 116.

As noted above, when gate 21 rotates between its operative and inoperative positions, conduit 23, shroud 28 and nozzle 47 all undergo a similar rotation, nozzle 47 moving between the positions illustrated in dash-dot lines at 47*a* and 47*b* in FIG. 3.

To prevent flexible feed line 51 (and any other flexible lines connected to nozzle 47) from being bent, twisted, kinked or the like as nozzle 47 rotates about vertical axis 30 of rotary gate 21, structure is provided for simultaneously rotating the nozzle about center line 52 of nozzle portion 49 (FIG. 4), in a rotational sense opposite the rotational sense in which rotary gate 21 rotates, during movement between the gate's operative and inoperative positions. This structure is shown in detail of FIGS. 2, 4, 5 and 9.

Surrounding that part of straight nozzle portion 49 located outside of shroud upper portion 28 is a collar 56 having an axis corresponding to center line 52 of nozzle portion 49. Collar 56 is mounted, in a manner to be subsequently described, for rotation relative to nozzle 47, about an axis corresponding to center line 52 of nozzle portion 49. A bracket, indicated generally at 57 connects collar 56 to vertically disposed conduit 23. Bracket assembly 57 and the rotational mounting of collar 56 relative to nozzle 47 cooperate to facilitate rotation of nozzle 47 about center line 52 during movement of conduit 23, shroud 27, nozzle 47 and rotary gate 21 about the rotary gate's vertical axis 30.

As a result of this arrangement, when rotary gate 21 moves in a clockwise sense, as viewed in FIG. 3, so that a projection 36 adjacent nozzle 47 moves from the position shown in solid lines to the position shown in dash-dot lines in FIG. 3, nozzle 47 will rotate in a counter-clockwise sense, about axis 52, from the radially disposed position shown at 47*a* in FIG. 3 to the tangentially disposed position shown at 47*b* in FIG. 3. Similarly, when gate 21 moves in a counter-clockwise sense, so that the projection 36 adjacent nozzle 47 moves from the position shown in dash-dot lines to the position shown in solid lines in FIG. 3, nozzle 47 will rotate in a clockwise sense about axis 52 from the tangential disposition shown at 47*b* in FIG. 3 to the radial disposition shown at 47*a* in FIG. 3.

In both positions of nozzle 47, that is both 47*a* and 47*b*, feed line 51 will extend from nozzle 47 in substantially parallel directions. This is because, in both positions 47*a* and 47*b*, nozzle portion 50, to which the feed line is attached, itself extends in substantially parallel directions. As a result, bending, twisting or kinking of feed line 51 is minimized.

If nozzle 47 were not mounted for rotation about axis 52, in the manner described above, it would extend in a radial disposition in both positions 47*a* and 47*b*. As such, at 47*b*, nozzle portion 50 would be extending at right angles to the direction in which it extends at 47*a*. Consequently, that portion of feed line 51 immediately adjacent nozzle portion 50 would be bent 90° as the nozzle rotated between positions 47*a* and 47*b*.

Referring now to FIGS. 2 and 4, center line 52 of straight nozzle portion 49 extends through upper portion 28 of shroud 27, upwardly and radially outwardly relative to center line 34 of conduit 23 (and relative to pivotal axis 30 of gate 21). Nozzle portion 50 extends from nozzle portion 49 substantially in a radial direction relative to center line 52 of nozzle portion 49.

Because center line 52 has both vertical and horizontal components, as nozzle portion 50 rotates through its arc of rotation about axis 52, it follows an arc having both vertical and horizontal components. Because of the tilt of center line 52 relative to center line 34 of conduit 23 and rotary gate axis 30, nozzle portion 50 extends in an outward radial direction relative to gate axis 30, when nozzle portion 50 is at the low point of its arc of rotation about center line 52. This is shown at 47*a* in FIG. 3. On the other hand, nozzle portion 50 extends in a tangential direction relative to the rotary gate's vertical axis 30 when nozzle portion 50 has been rotated 90° through its arc of rotation from the low point of the arc. This is shown at 47*b* in FIG. 3.

In the absence of other restraints, nozzle portion 50 is normally urged by gravity toward its radial disposition (47*a* in FIG. 3) which is the low point of its arc of rotation about center line 52 (FIG. 4). When rotary gate 21 is at its inoperative position (dash-dot lines for projection 36 in FIG. 3), conduit 23 and shroud 27 are at similar non-operative positions. As conduit 23 and shroud 27 move from their operative to their inoperative positions during rotation of gate 21, flexible feed line 51 (and any other flexible feed line connected to nozzle portion 50) urges nozzle portion 50 to rotate towards its tangential position (47*b* in FIG. 3). When all of elements 21, 23, 27 and 47 are rotated back from their inoperative to their operative positions, the force of gravity normally urging nozzle portion 50 towards its radial disposition (47*a* in FIG. 3) operates to produce that result. As a consequence, nozzle portion 50 will extend in substantially the same general direction, whether the nozzle is radially disposed (47*a* in FIG. 3) or tangentially disposed (47*b* in FIG. 3). Accordingly, that part of the feed line adjacent nozzle 47 (connected to the upstream end of nozzle portion 50), will also extend in substantially the same general direction, no matter the position to which the nozzle has been rotated. As a result, bending, twisting, kinking or the like of feed line 51 (or any other flexible line connected to nozzle 47) is minimized.

Figure 9:
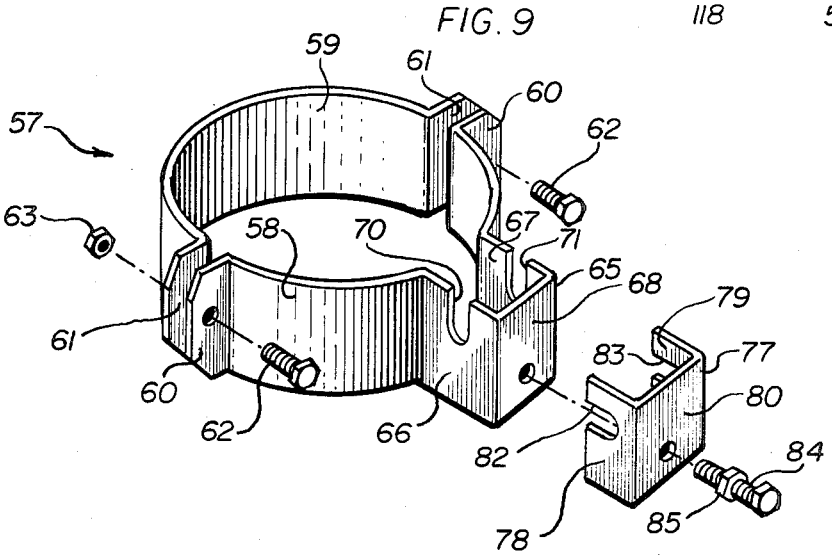
FIG. 9 is an exploded perspective illustrating a mounting bracket in accordance with the present invention.

The mounting structure for nozzle 47 and collar 56 will now be described in more detail, with reference to FIGS. 2, 4 and 9. Bracket assembly 57 comprises a pair of semi-circular bracket portions 58, 59 each having a respective pair of ears 60, 60 and 61, 61. Bracket portions 58, 59 fit around and substantially surround conduit 23 (FIG. 4) and are held in tight embracing engagement around conduit 23 by bolts 62, 62 extending through appropriate openings in ears 60 and 61 and engaged by nuts 63.

Extending radially outwardly from semi-circular bracket portion 58 and disposed along side conduit 23 is U-shaped bracket portion 65 which embraces collar 56. U-shaped bracket portion 65 has a pair of parallel sides 66, 67 connected by an end 68. Each of parallel sides 66, 67 has a respective substantially vertically disposed slot 70, 71 each of which has an open upper end. Each slot 70, 71 receives a respective one of a pair of horizontally disposed pivot pins 72 (only one of which is shown) extending in mutually opposite directions from collar 56 (FIG. 4). The horizontal pivotal axis of pins 72 is radially spaced from vertical axis 34 of conduit 23. Slots 70, 71 and pivot pins 72 constitute structure mounting collar 56 for pivotal movement with nozzle 47, about a horizontal axis, to accommodate angular adjustment of center line 52 of nozzle portion 49 relative to vertical center line 34 of conduit 23. This facilitates the insertion of nozzle portion 49 into opening 48 in shroud upper portion 28.

As a result of the structure described above, collar 56 is held by bracket assembly 57 and is incapable of rotating relative to tube 23 or shroud 27. Nozzle 47, however, is capable of rotating relative to collar 56, tube 23 and shroud 27 by virtue of the structure now to be described. Rigidly attached to that part of nozzle portion 49 normally located outside of the shroud's upper portion 28, are a pair of bearing plates 74, 75 (FIG. 5) each located at a respective opposite end of collar 56, but not secured thereto. Bearing plates 74, 75 mount nozzle 47 for rotation about center line 52, relative to collar 56.

Collar 56 and its pivot pins 72 ar held in bracket slots 70, 71 by locking structure now to be described. A second U-shaped bracket portion 77 embraces first U-shaped bracket portion 65 and comprises a pair of parallel arms 78, 79 joined by an end 80. Each of arms 78, 79 has a respective, substantially horizontally disposed slot 82, 83 each of which has an open outer end. Each slot 82, 83 receives a respective pivot pin 72. Each arm 78, 79 on second U-shaped bracket portion 77 comprises structure for closing the open upper end of a respective vertically disposed slot 70, 71 on first U-shaped bracket portion 65. Similarly, each side 66, 67 on first U-shaped bracket portion 65 comprises structure for closing the open outer end of a respective horizontally disposed slot 82, 83 on second U-shaped bracket portion 77. The first and second U-shaped bracket portions 65, 77 are held together by a bolt 84 and a pair of nuts 85, 86 (FIG. 4).

Absent a mounting arrangement of the type described above, which permits nozzle 47 to rotate about center line 52 during rotation of conduit 23, shroud 27 and nozzle 47 about vertical axis 30 of rotary gate 21, an undue amount of stress would be applied against shroud 27, at opening 48, by nozzle 47, during rotation about vertical gate axis 30. Referring to FIG. 4, absent the aforementioned mounting arrangement, the outer surface of cylindrical nozzle 47 would bear against the upper edge 88 of opening 48, at a point on the upper edge, and the nozzle's outer surface also would bear against the lower edge 89 of opening 48, at a point on the lower edge 180° opposite the point on the upper edge of opening 88 at which nozzle 47 bears. This would create a concentration of stresses at the two points of contact which could eventually cause cracks or the like in shroud 27 at opening 48, and that would of course be undesirable.

Rotary gate 21 is circular, as shown in FIG. 3, and its lower plate 115 is rotated by mechanical structure of a conventional nature, not shown, but which includes a peripheral gearing attached to lower plate 115 and engaged by a gear in turn driven by a motor mounted on the bottom of ladle 20.

Referring to FIGS. 2 and 4, upper shroud portion 28 has a vent opening 87 for minimizing the accumulation of gases and vapors within shroud 27.

Referring again to FIG. 1, mounted along the bottom of manipulator arm 42 are rollers 91 (only one of which is shown) which move along a track 92 on manipulator base 43 to mount arm 42 for back and forth movement relative to base 43. Also located along the bottom of arm 42 is a rack 93 engaged by a manually powered gear (not shown) on base 43 for driving arm 42 in its back and forth movement. As previously noted, the mounting arrangements for manipulator arm 42 enable it to move back and forth relative to base 43 and to pivot about axis 45 of shaft 44, and this mobility enables manipulator arm 42 to automatically adjust to rotation of conduit 23 about vertical axis 30 of rotary gate 21, thereby to maintain conduit 23 in intimate engagement with rotary gate projection 36 during that rotation.

The structure which imparts the above-described mobility to arm 42 cooperates with other structure on the manipulator for positioning conduit 23 and shroud 27 within tundish 31 and in communication with projection 36 on rotary ladle gate 21. This includes the pivotal mounting of conduit 23 on arm 42, at pivot pins 40, which permits one to manually tilt conduit 23 about the pivotal axis of pins 40. In addition, shaft 45 is mounted for vertical movement to enable the raising or lowering of arm 42. In some embodiments, manipulator base 43 and arm 42 can be pivoted about a horizontal axis transverse to vertical axis 45 of shaft 44, so as to dip the remote end of arm 42, where ears 41 are located.

Referring now to FIGS. 5–8, there is illustrated structure for circulating a cooling fluid through nozzle 47. More particularly, nozzle 47 comprises an inner tubular member 95 having an outer surface 96 and an outer tubular member 97 having an inner surface 98 spaced from the inner tubular members outer surface 96. Spaced surfaces 96, 98 define an annular space 99 therebetween. Dividing annular space 99 into two substantially non-communicating, fractionally annular sections 102, 103 are a pair of longitudinally extending baffles 100, 101 spaced 180° apart from each other in the illustrated embodiment. Baffles 100, 101 comprise structure for blocking fluid passage between the two fractionally annular sections 102, 103.

Figure 8:
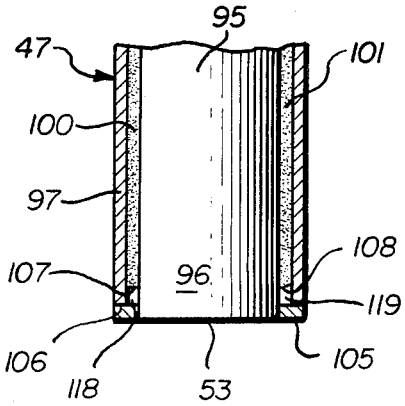
FIG. 8 is a fragmentary, sectional view illustrating the downstream end of the nozzle of FIG. 5, rotated 90 degrees relative to the showing in FIG. 5.

Referring to FIG. 8, the downstream open end 53 of nozzle 47 is defined by the downstream end of inner tubular member 95. Outer tubular member 97 has a downstream end 106 which terminates slightly upstream of the inner tubular member's downstream end 53. Baffles 100 and 101 have downstream ends 107, 108 which terminate slightly upstream of downstream end 106 of outer tubular member 97. Closing the space between outer tubular member 97 and inner tubular member 95 at their downstream ends is a ring 105 having its inner surface secured to the outer surface 96 of inner tubular member 95 and an upper surface secured to the downstream end 106 of outer tubular member 97. Because the downstream ends 107, 108 of baffles 100, 101 terminate slightly upstream of the upstream surface of ring 106, there are passages 118, 119 defined between baffles 100, 101 and ring 106, and these passages communicate the two fractionally annular sections 102, 103, adjacent the downstream end of nozzle 47, to permit fluid passage between the two fractionally annular sections.

Figure 5:
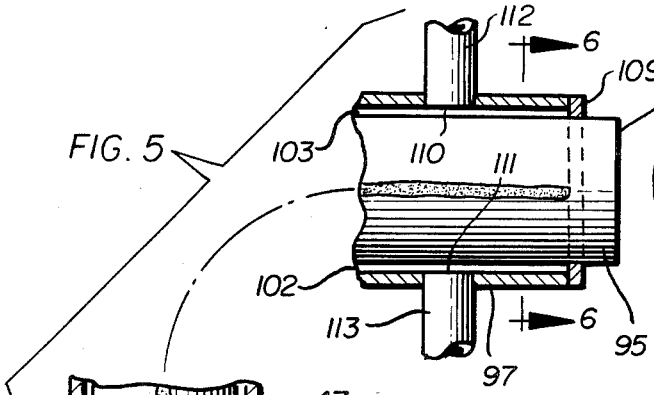
FIG. 5 is an enlarged, fragmentary sectional view of an embodiment of a nozzle employed in accordance with the present invention.
Figure 6:
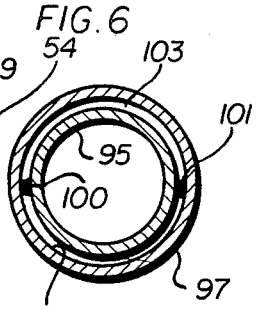
FIG. 6 is a sectional view taken along line 6—6 in FIG. 5.
Figure 7:
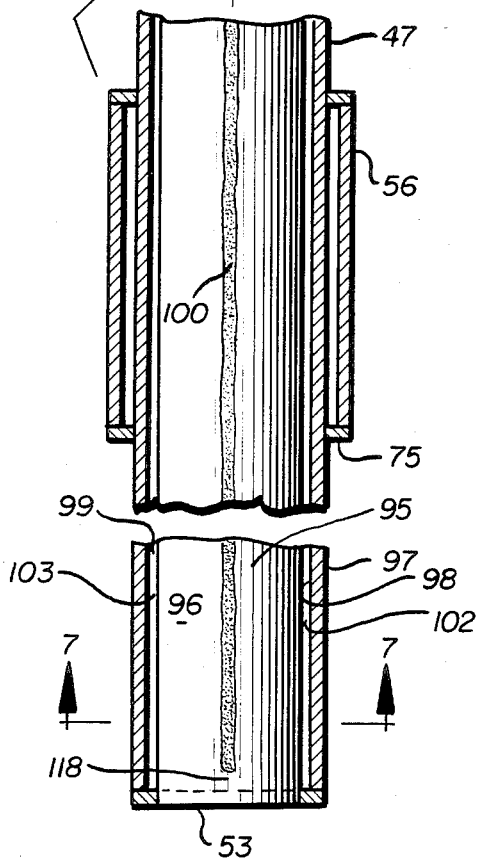
FIG. 7 is a sectional view taken along line 7—7 in FIG. 5.
Figure 7:
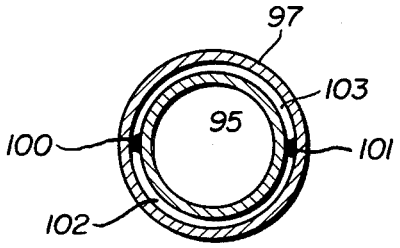

The space between inner and outer tubular members 95, 97 is closed adjacent upper end 54 of nozzle 47 by a ring 109 (FIG. 5).

Located adjacent the nozzle's upstream open end 54, at a location far upstream of passages 118–119, is structure for introducing and withdrawing a cooling fluid. More particularly, a flexible feed line or conduit 94 (FIG. 1) terminates at a fitting 112 communicating with an inlet opening 110 communicating with fractionally annular section 103 located between the outer and inner tubular members of the nozzle. Located on an opposite side of nozzle 47 from inlet opening 110 is an outlet opening 111 communicating with fractionally annular section 102 located between the inner and outer tubular members of the nozzle. Outlet opening 111 in turn communicates with an outlet fitting 113.

Feed line 112 introduces a cooling fluid such as air at ambient temperature, into fractionally annular section 103. The cooling fluid flows downstream through fractionally annular section 103, then through passages 118, 119 adjacent downstream end 53 of nozzle 47, into fractionally annular section 102 and then upstream through fractionally annular section 102 to outlet opening 111. As the cooling fluid follows the path described in the previous sentence, it absorbs heat from the nozzle, which warms the cooling fluid, and the warmed cooling fluid is exhausted, e.g. to the atmosphere, through outlet fitting 113. Outlet opening 111 need not be directly opposite inlet opening 110, but it should be located outside of shroud 27. This is to prevent cooling fluid from being exhausted within the shroud and having a cooling effect therein.

Inlet opening 110 should also be located outside of shroud 27, as contrasted to being located inside shroud 27 which could cause the cooling fluid to be preheated too much before it entered the nozzle for cooling purposes. In addition, an inlet opening inside the shroud would be relatively inaccessible.

Each baffle 100, 101 comprises a linear weld which secures together the inner and outer tubular members 95, 97.

The foregoing detailed description has been given for clearness of understanding only, and no unnecessary limitations should be understood therefrom, as modification will be obvious to those skilled in the art.

We claim:

1. In combination:

a vertically disposed conduit having a vertically disposed center line and upper and lower open ends;

a vertically disposed, tubular shroud enclosing the lower portion of said conduit and having an open lower end;

means mounting said shroud to said conduit for movement of the shroud and the conduit together;

means mounting said conduit for rotational movement with said shroud, about a vertical first axis spaced from the vertical center line of said conduit;

a rigid injector nozzle having a straight portion extending through said shroud;

a flexible feed line extending away from said conduit;

said nozzle having a downstream open end communicating with the interior of said shroud and an upstream open end for connection to said flexible feed line;

said straight portion of the nozzle terminating at said downstream nozzle end and having a center line extending in a direction having a vertical component;

collar means having an axis and surrounding said straight nozzle portion;

said collar axis being co-linear with said center line of said straight nozzle portion;

first means mounting said collar means for rotational movement about its axis, relative to said nozzle;

and means connecting said collar means to said conduit;

said first mounting means for the collar means and said connecting means for the collar means comprising means cooperating to facilitate rotation of the nozzle about said center line of the nozzle's straight portion during said rotational movement of the conduit.

2. In the combination of claim 1 wherein said connecting means for the collar means comprises:

means mounting said collar means for pivotal movement, with said nozzle, about a horizontal axis spaced from said vertical center line of the conduit, to accommodate angular adjustment of the center line of the nozzle's straight portion relative to the vertical center line of the conduit.

3. In the combination of claim 2:

locking means for holding said collar means in said pivotal mounting means.

4. In the combination of claim 2 wherein said pivotal mounting means comprises:

first bracket means disposed alongside said conduit and embracing said collar;

a pair of horizontally disposed pivot pins each extending in a respective opposite direction from said collar means along a mutual center line;

said first bracket means comprising a pair of parallel sides each having a substantially vertically disposed slot, each slot comprising means for receiving a respective one of said pivot pins and fo pivotally mounting the pin.

5. In the combination of claim 4 wherein:

each slot on said first bracket means has an open upper end;

and said combination comprises locking means for holding said pivot pins in said vertical slots.

6. In the combination of claim 5 wherein said locking means for holding the pivot pins comprises:

second bracket means comprising a pair of parallel arms each having a substantially horizontally disposed slot with an open outer end, each of said horizontally disposed slots comprising means for receiving a respective one of said pivot pins;

each of said arms on the second bracket means comprising means for closing the open upper end of a respective vertically disposed slot on the first bracket means;

and each of said sides on the first bracket means comprises means for closing the open outer end of a respective horizontally disposed slot on the second bracket means;

and means for securing said second bracket means to the first bracket means.

7. In the combination of claim 1 wherein said nozzle comprises:

an inner tubular member having an outer surface;

an outer tubular member having an inner surface spaced from the outer surface of said inner tubular member;

said spaced surfaces defining an annular space therebetween;

baffle means dividing said annular space into two noncommunicating, fractionally annular sections;

said baffle means comprising means for blocking fluid passage between said two fractionally annular sections;

passage means at the downstream end of said nozzle, communicating the two fractionally annular sections to permit fluid passage therebetween;

inlet means, located upstream on said nozzle from said passage means, communicating with one of said fractionally annular sections, for introducing fluid into said one section;

and outlet means, located upstream on the nozzle from said passage means, communicating with the other of said fractionally annular sections, for withdrawing fluid from said other section.

8. In the combination of claim 7 wherein:

said baffle means comprises a pair of elongated welds each securing said inner and outer tubular members together.

9. In the combination of claim 7 wherein:

both said fluid inlet means and said fluid outlet means are located outside said tubular shroud.

10. In combination:

a vertically disposed conduit having a vertically disposed center line and upper and lower open ends;

a vertically disposed, tubular shroud enclosing the lower portion of said conduit;

means mounting said shroud to said conduit for movement of the shroud and the conduit together;

means mounting said conduit for rotation with said shroud, between operative and inoperative positions, about a vertical first axis spaced from the vertical center line of said conduit;

a rigid injector nozzle having a straight portion extending through said shroud;

said straight portion having a center line;

a flexible feed line extending away from said conduit;

said nozzle having a downstream open end communicating with the interior of said shroud and an upstream open end for connection to said flexible feed line;

and means mounting said nozzle for rotation with said shroud about said vertical first axis, in a first sense, and for simultaneous rotation about said center line of the straight nozzle portion, in a second sense opposite said first sense.

11. In the combination of claim 10 wherein:

said center line of said straight nozzle portion extends through the shroud upwardly and radially outwardly relative to the center line of said vertically disposed conduit;

said nozzle has another portion extending from said straight nozzle portion in a radial direction relative to said center line of the straight nozzle portion;

said other nozzle portion rotates through an arc, having both vertical and horizontal components, when the nozzle rotates about said center line of the straight nozzle portion;

said other nozzle portion extends in an outward, substantially radial direction relative to said first vertical axis of rotation when said straight nozzle portion is at the low point of said arc;

and said other nozzle portion extends in a substantially tangential direction relative to said first vertical axis when the other nozzle portion has been rotated 90° through its arc of rotation from the low point of said arc.

12. In the combination of claim 11 and comprising:

gravity means normally urging said other nozzle portion towards its radial disposition;

and means urging said other nozzle portion towards its tangential disposition when said vertically disposed conduit and shroud are at their inoperative dispositions.

13. In the combination of claim 12 and comprising:

means, including said gravity means, urging said other nozzle portion towards its radial disposition when the vertically disposed conduit and shroud are at their operative dispositions.

14. A rigid injector nozzle for use with a tubular shroud enclosing a vertical stream of molten metal and a flexible feed line, said nozzle comprising:

a downstream open end for communicating with the interior of said tubular shroud and an upstream open end for connection to said flexible feed line;

said nozzle having a portion for extending through said shroud, terminating at said downstream end and having a center line;

collar means having an axis and surrounding said nozzle upstream of and adjacent said nozzle portion;

said collar axis being co-linear with said center line of said nozzle portion;

first means mounting said collar means for rotational movement about its axis, relative to said nozzle;

and a pair of horizontally disposed pivot pins each extending in a respective opposite direction from said collar means along a mutual center line.

15. A rigid injector nozzle for use with a tubular shroud enclosing a vertical stream of molten metal and a flexible feed line, said nozzle comprising:

a downstream open end for communicating with the interior of said tubular shroud and an upstream open end for connection to said flexible feed line at a location outside said tubular shroud;

an inner tubular member having an outer surface;

an outer tubular member having an inner surface spaced from the outer surface of said inner tubular member;

said spaced surfaces defining an annular space therebetween;

baffle means dividing said annular space into two noncommunicating, fractionally annular sections;

said baffle means comprising means for blocking fluid passage between said two fractionally annular sections;

passage means at the downstream end of said nozzle, communicating the two fractionally annular sections to permit fluid passage therebetween;

inlet means, located upstream on said nozzle from said passage means, communicating with one of said fractionally annular sections, for introducing fluid into said one communicating section;

and outlet means, located upstream on the nozzle from said passage means, communicating with the other of said fractionally annular sections, for withdrawing fluid from said other section.

16. A nozzle as recited in claim 15 wherein:

said baffle means comprises a pair of elongated welds each securing said inner and outer tubular members together.

17. A nozzle as recited in claim 16 wherein:

both said fluid inlet means and said fluid outlet means are located adjacent the upstream end of the nozzle for positioning outside said tubular shroud.

* * * * *